US011411307B2

(12) United States Patent
Durbin et al.

(10) Patent No.: US 11,411,307 B2
(45) Date of Patent: Aug. 9, 2022

(54) PINWHEEL THREE-WAY WILKINSON POWER DIVIDER FOR MILLIMETER WAVE APPLICATIONS

(71) Applicant: Anokiwave, Inc., San Diego, CA (US)

(72) Inventors: Jason Leo Durbin, San Diego, CA (US); Trang Thai, San Diego, CA (US); Peter Moosbrugger, San Diego, CA (US)

(73) Assignee: Anokiwave, Inc., San Diego, CA (US)

( * ) Notice: Subject to any disclaimer, the term of this patent is extended or adjusted under 35 U.S.C. 154(b) by 0 days.

(21) Appl. No.: 17/502,426

(22) Filed: Oct. 15, 2021

(65) Prior Publication Data

US 2022/0123462 A1 Apr. 21, 2022

Related U.S. Application Data

(60) Provisional application No. 63/092,802, filed on Oct. 16, 2020.

(51) Int. Cl.

| | |
|---|---|
| ***H01Q 1/50*** | (2006.01) |
| ***H01Q 21/00*** | (2006.01) |
| ***H01P 5/16*** | (2006.01) |

(52) U.S. Cl.
CPC ..... *H01Q 1/50* (2013.01); *H01P 5/16* (2013.01); *H01Q 21/0006* (2013.01)

(58) Field of Classification Search
CPC ..... H01Q 1/50; H01Q 21/0006; H01P 5/16
See application file for complete search history.

(56) References Cited

U.S. PATENT DOCUMENTS

| | | | | |
|---|---|---|---|---|
| 9,171,121 | B2 * | 10/2015 | Ding | H01L 23/481 |
| 2003/0227352 | A1 | 12/2003 | Kolehmainen et al. | |
| 2011/0043301 | A1 | 2/2011 | Huettner | |

FOREIGN PATENT DOCUMENTS

| | | | | |
|---|---|---|---|---|
| CN | 108511880 | A | 9/2018 | |
| CN | 108808199 | A | 11/2018 | |
| CN | 110474137 | A | 11/2019 | |
| CN | 111540997 | A * | 8/2020 | H01P 5/183 |

OTHER PUBLICATIONS

Chen Y., et al., "A Wide Bank Multiport Planar Power Divider Design By Radially Combining Matched Sectorial Components," retrieved from the internet on Feb. 24, 2022 at http://ntur.lib.ntu.edu.tw/bitstream/246246/2007041910031867/1/00602817.pdf, dated 1997, 4 pages.

(Continued)

*Primary Examiner* — Stephen E. Jones
*Assistant Examiner* — Kimberly E Glenn
(74) *Attorney, Agent, or Firm* — Nutter McClennen & Fish LLP

(57) ABSTRACT

A symmetric, multi-layer, three-way power divider that is equally balanced, with resistors placed between all combinations of legs. This three-way power divider is specifically designed to be used in millimeter wave applications (e.g., 5G in the 20 GHz-40 GHz range for both dual and single polarization), specifically in designs where a common signal is distributed to a multiple of three elements. This three-way power divider also can be useful for addressing space constraints in 5G applications, e.g., due to routing limitations.

33 Claims, 10 Drawing Sheets

(56) References Cited

OTHER PUBLICATIONS

Chen Y., et al., "A Wide-Bank Multiport Planar Power-Divider Design Using Matched Sectorial Components in Radial Arrangement," IEEE Transactions of Microwave Theory and Techniques, Aug. 1998, vol. 46, Issue No. 8, pp. 1072-1078.
Korean Intellectual Property Office, Jeong Rok Yang, Authorized officer, International Search Report for Application No. PCT/US2021/055169, dated Feb. 11, 2022, together with the Written Opinion of the International Searching Authority, 7 pages.

* cited by examiner

FIG. 1 – PRIOR ART

FIG. 2 – PRIOR ART

FIG. 3 – PRIOR ART

Isolation
S-Parameters [Magnitude in dB]
Frequency / GHz
dB
-4
-6
-8
-10
-12
-14
-16
-18
-20
-22
-24
26
28
30
32
34
36
38
40
42
44
46
48
50
52
54
56
58
60
62
64
66
68
70
72
74
76
78
80
82
84
86
88
90
92
94
96
98
100
102
104

PINWHEEL THREE-WAY WILKINSON POWER DIVIDER FOR MILLIMETER WAVE APPLICATIONS

CROSS-REFERENCE TO RELATED APPLICATION(S)

This patent application claims the benefit of U.S. Provisional Patent Application No. 63/092,802 entitled PINWHEEL THREE-WAY WILKINSON POWER DIVIDER FOR MILLIMETER WAVE APPLICATIONS filed Oct. 16, 2020, which is hereby incorporated herein by reference in its entirety.

FIELD OF THE INVENTION

Illustrative embodiments of the invention relate to Wilkinson power dividers for millimeter wave applications.

BACKGROUND OF THE INVENTION

Wilkinson power dividers are used in many electronic applications such as, for example, radio frequency communication systems, phased array systems, radar systems, and other applications that require distribution of a signal from a common port to multiple distribution ports. Wilkinson power dividers can achieve isolation between the distribution ports while maintaining a matched condition on all ports. Wilkinson power dividers generally can be cascaded in order to increase the number of distribution ports, e.g., the use of three 2-way Wilkinson power dividers can be cascaded to produce four distribution ports. Wilkinson power dividers also can be used in reverse to combine signals from the distribution ports to the common port. Thus, for example, Wilkinson power dividers can be used in transceiver systems in which a transmit signal provided on the common port is divided among the multiple distribution ports and in which received signals from the multiple distribution ports are combined to form a common signal on the common port.

FIG. 1 is a schematic diagram showing one type of planar three-way power divider as known in the art. The layout of this divider can be formed on a single layer of a printed circuit board (PCB) or other substrate. In this example, port 1 is the common port and ports 2, 3, and 4 are the distribution ports. Note here that the middle leg is not symmetric with the outer legs, and there is no isolation resistor between legs 2 and 4.

FIG. 2 is a schematic diagram showing one type of multi-layer three-way power divider as known in the art. The layout of this divider is formed on multiple layers of a printed circuit board (PCB) or other substrate. In this example, port 1 is the common port and ports 2, 3, and 4 are the distribution ports. Note here that there are resistors between every leg combination, but the middle leg is on a different layer than the other structures and the divider is not symmetric.

FIG. 3 is a schematic diagram showing one type of radial or pinwheel N-way power divider as known in the art. In this example, the center hub represents the common port.

SUMMARY OF VARIOUS EMBODIMENTS

In accordance with one embodiment, an apparatus comprises a three-way Wilkinson power divider for millimeter wave applications, the power divider comprising a distribution port layer and a common port layer separated by at least one intermediate material layer including at least one insulating material layer; the distribution port layer formed of a first conductive material and including exactly three distribution legs connected to and arranged symmetrically around a center hub in a pinwheel arrangement with resistor leads substantially at a predetermined quarter wavelength position of the legs relative to the center hub for connection of isolation resistors substantially midway between each pair of adjacent distribution legs; and the common port layer formed of a second conductive material and including a common port leg having an oblong body that electrically connects to the center hub of the distribution port layer by a conductive connection through the at least one intermediate material layer, wherein the oblong body of the common port leg is configured for matching to the three distribution legs and wherein the power divider exhibits isolated and balanced operation at millimeter wave frequencies.

In various alternative embodiments, the resistor leads may be curved, in which case the curved resistor leads may be configured to form a substantially circular ring interconnecting the three distribution port legs substantially at the quarter wavelength position of the legs relative to the center hub when the isolation resistors are connected to the resistor leads, wherein the curved resistor leads and substantially circular ring may provide enhanced isolation between the distribution ports. Each resistor lead may include a proximal end coupled to a distribution leg and a distal end having a pad for connecting an isolation resistor, wherein the pad may be a pad for surface-mounting the isolation resistor and wherein the proximal end may be co-formed with the distribution leg. The oblong body may be a tear-shaped body. The conductive connection may be a via.

Embodiments may further include the isolation resistors connected to the resistor leads substantially midway between each pair of adjacent distribution legs. Additionally or alternatively, embodiments may further include a printed circuit board (PCB) on which the power divider is embodied, the PCB including at least the distribution port layer and the common port layer separated by the at least one intermediate material layer including the at least one insulating material layer. In such embodiments, the apparatus may further include first, second, and third RF circuitry, wherein each of the first, second, and third RF circuitry is coupled to a distinct one of the three distribution legs and at least one of a common signal from the common port leg is distributed via the power divider to the first, second, and third RF circuitry or signals from the first, second, and third RF circuitry are combined by the power divider to form a common signal provided to the common port leg. Each of the first, second, and third RF circuitry may include beamforming circuitry or an RF integrated circuit and may be coupled to at least one RF element. Embodiments also may include RF common circuitry coupled to the common port leg.

In accordance with another embodiment, an RF integrated circuit for millimeter wave applications comprises a three-way Wilkinson power divider comprising a distribution port layer and a common port layer separated by at least one intermediate material layer including at least one insulating material layer; the distribution port layer formed of a first conductive material and including exactly three distribution legs connected to and arranged symmetrically around a center hub in a pinwheel arrangement with isolation resistors connected to the legs substantially at a predetermined quarter wavelength position of the legs relative to the center hub and with the isolation resistors positioned substantially midway between each pair of adjacent distribution legs; and the common port layer formed of a second conductive material and including a common port leg having an oblong body that electrically connects to the center hub of the distribution port layer by a conductive connection through the at least one intermediate material layer, wherein the oblong body of the common port leg is configured for matching to the three distribution legs and wherein the power divider exhibits isolated and balanced operation at millimeter wave frequencies.

In various alternative embodiments, the isolation resistors may be coupled to the legs using curved resistor leads, in which case the curved resistor leads with connected isolation resistors may form a substantially circular ring interconnecting the three distribution port legs substantially at the quarter wavelength position of the legs relative to the center hub when the isolation resistors are connected to the resistor leads, wherein the curved resistor leads and substantially circular ring may provide enhanced isolation between the distribution ports. Each resistor lead may include a proximal end coupled to a distribution leg and a distal end having a pad for connecting an isolation resistor, wherein the pad may be a pad for surface-mounting the isolation resistor and wherein the proximal end may be co-formed with the distribution leg. The oblong body may be a tear-shaped body. The conductive connection may be a via. The RF integrated circuit may be a beamforming integrated circuit, a conditioning integrated circuit, or an interface integrated circuit. The RF integrated circuit may include first, second, and third RF circuitry, wherein each of the first, second, and third RF circuitry is coupled to a distinct one of the three distribution legs and at least one of a common signal from the common port leg is distributed via the power divider to the first, second, and third RF circuitry or signals from the first, second, and third RF circuitry are combined by the power divider to form a common signal provided to the common port leg. Each of the first, second, and third RF circuitry may include beamforming circuitry. The RF integrated circuit also may include RF common circuitry coupled to the common port leg.

In accordance with another embodiment, a phased array system comprises first, second, and third RF circuitry and a three-way Wilkinson power divider comprising a distribution port layer and a common port layer separated by at least one intermediate material layer including at least one insulating material layer; the distribution port layer formed of a first conductive material and including exactly three distribution legs connected to and arranged symmetrically around a center hub in a pinwheel arrangement with isolation resistors connected to the legs substantially at a predetermined quarter wavelength position of the legs relative to the center hub and with the isolation resistors positioned substantially midway between each pair of adjacent distribution legs; and the common port layer formed of a second conductive material and including a common port leg having an oblong body that electrically connects to the center hub of the distribution port layer by a conductive connection through the at least one intermediate material layer, wherein the oblong body of the common port leg is configured for matching to the three distribution legs and wherein the power divider exhibits isolated and balanced operation at millimeter wave frequencies, wherein each of the first, second, and third RF circuitry is coupled to a distinct one of the three distribution legs, and wherein at least one of a common signal from the common port leg is distributed via the power divider to the first, second, and third RF circuitry or signals from the first, second, and third RF circuitry are combined by the power divider to form a common signal provided to the common port leg.

In various alternative embodiments, each of the first, second, and third RF circuitry may include beamforming circuitry or an RF integrated circuit and may be coupled to at least one RF element. The phased array system also may include RF common circuitry coupled to the common port leg.

Additional embodiments may be disclosed and claimed.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

It should be noted that the foregoing figures and the elements depicted therein are not necessarily drawn to consistent scale or to any scale. Unless the context otherwise suggests, like elements are indicated by like numerals. The drawings are primarily for illustrative purposes and are not intended to limit the scope of the inventive subject matter described herein.

DESCRIPTION OF ILLUSTRATIVE EMBODIMENTS

Exemplary embodiments provide a symmetric, multi-layer, three-way power divider that is equally balanced, with resistors placed between all combinations of legs. This three-way power divider is specifically designed to be used in millimeter wave applications (e.g., 5G in the 20 GHz-40 GHz range for both dual and single polarization), specifically in designs where a common signal is distributed to a multiple of three elements. This three-way power divider also can be useful for addressing space constraints in 5G applications, e.g., due to routing limitations.

Figure 1:
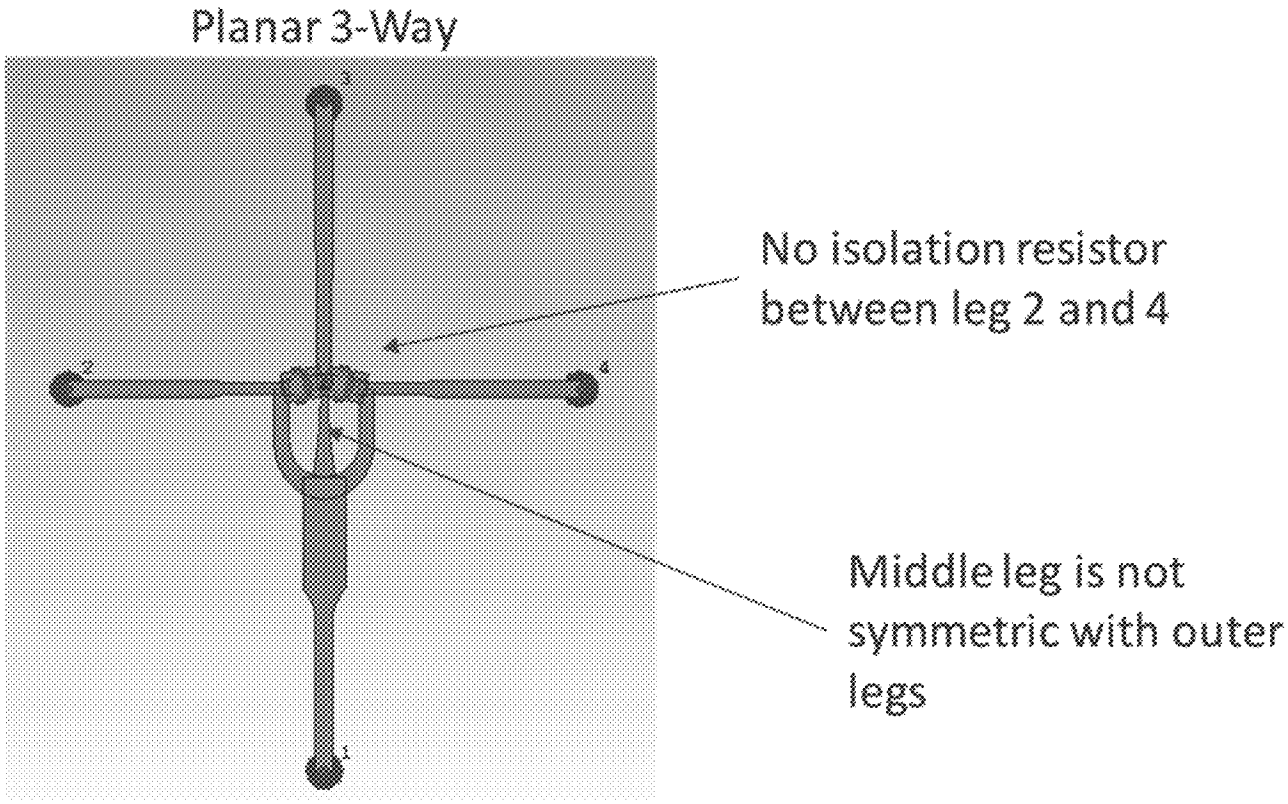
FIG. 1 is a schematic diagram showing one type of planar three-way power divider as known in the art.
Figure 2:
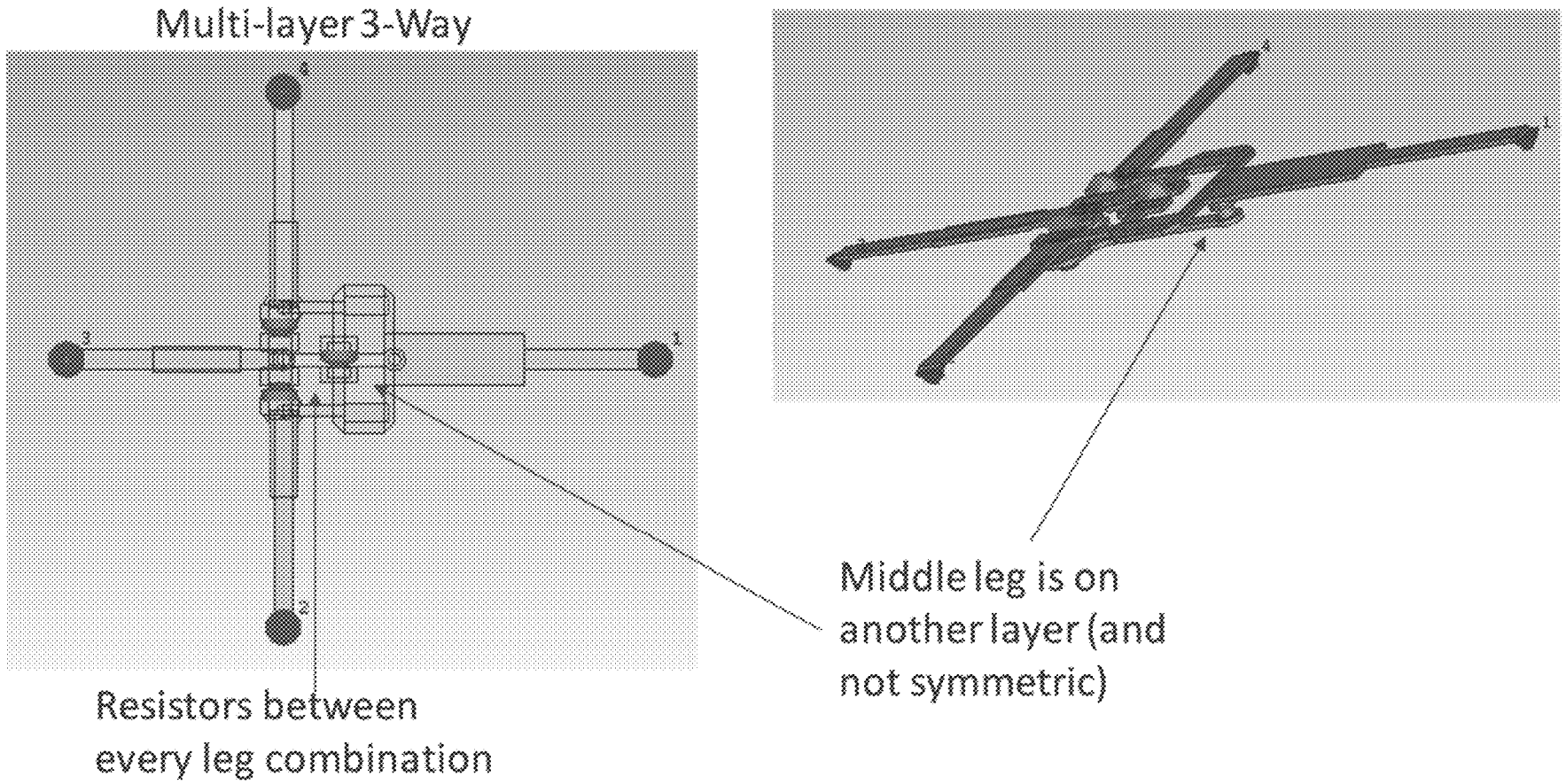
FIG. 2 is a schematic diagram showing one type of multi-layer three-way power divider as known in the art.
Figure 3:
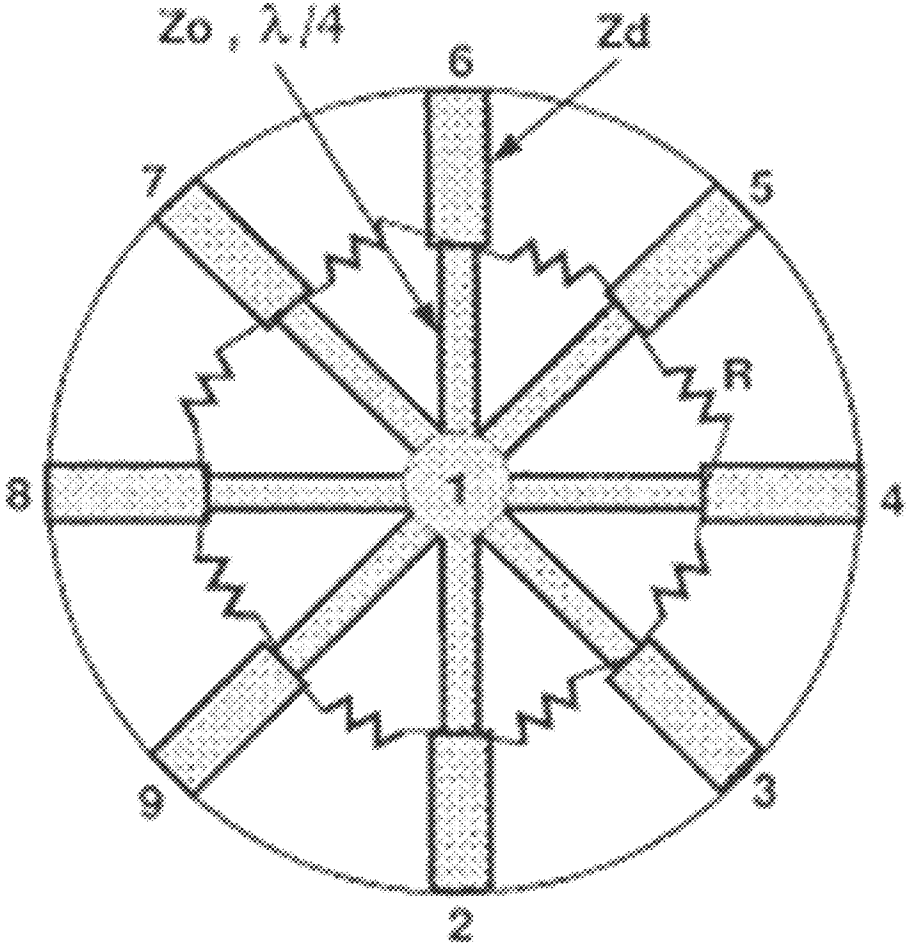
FIG. 3 is a schematic diagram showing one type of radial N-way power divider as known in the art.
Figure 4:
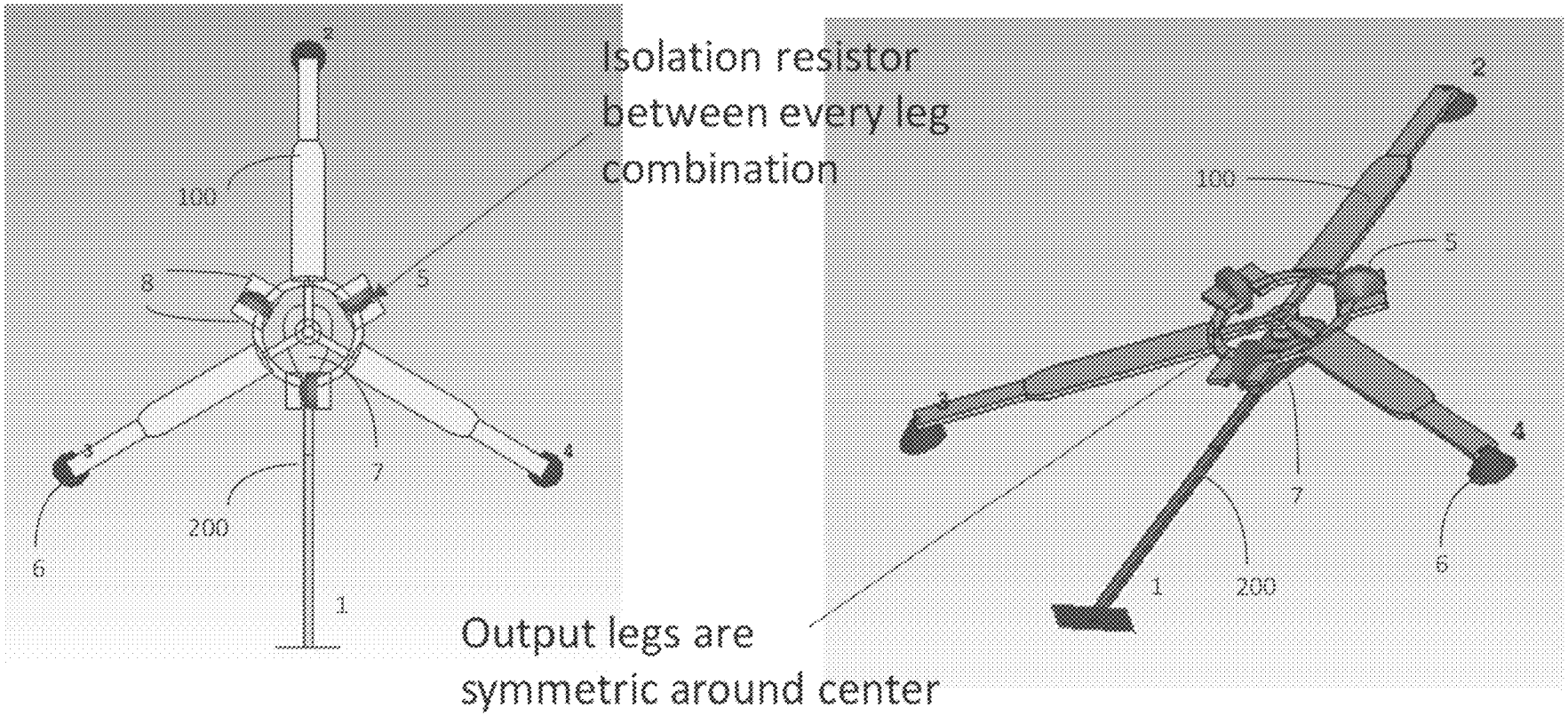
FIG. 4 is a schematic diagram showing a top view and a perspective view of a symmetric, multi-layer, three-way Wilkinson power divider in accordance with an exemplary embodiment of the invention.
Figure 5:
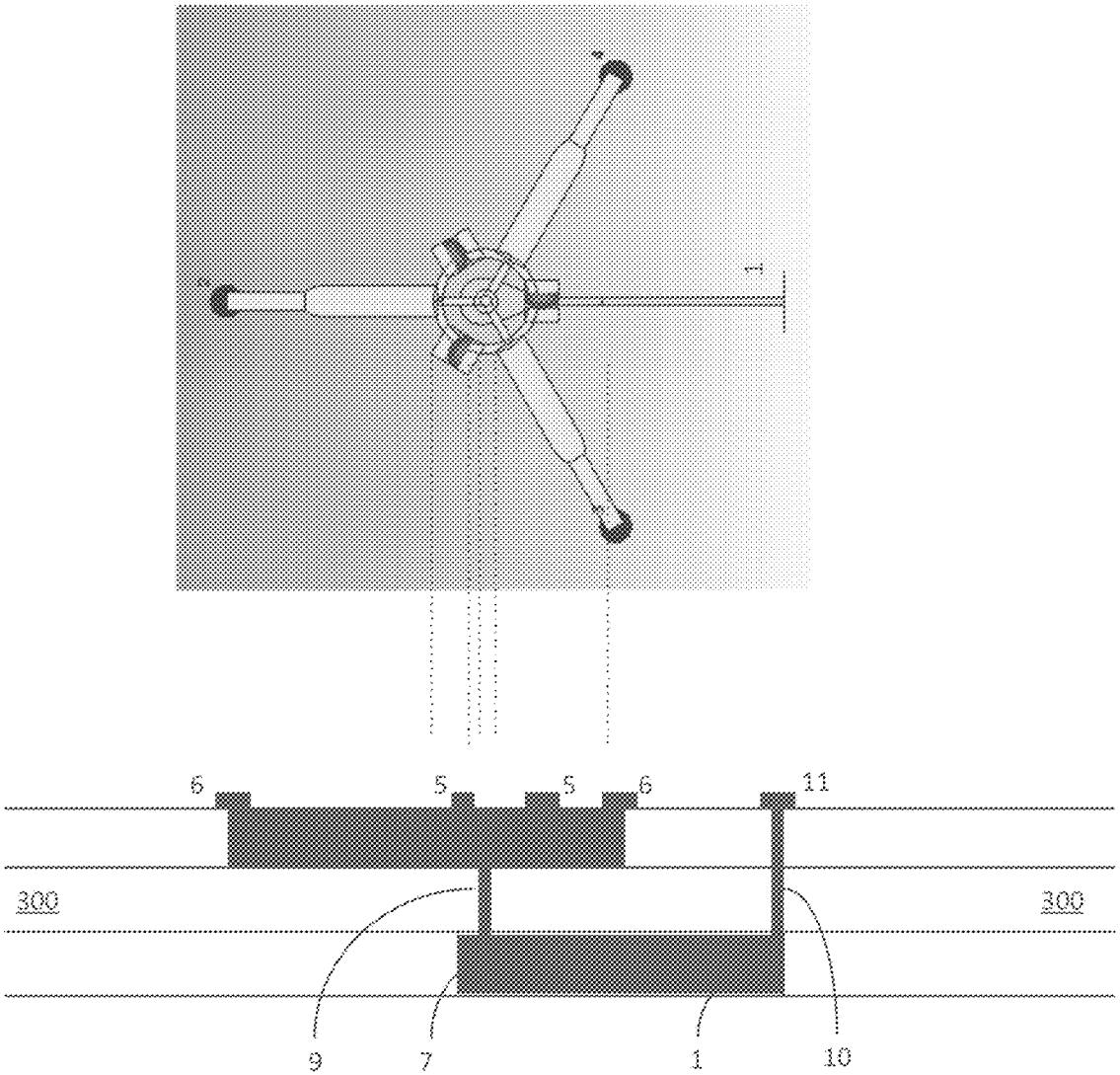
FIG. 5 is a schematic cross-sectional side view diagram showing the multi-layer structure of the three-way power divider of FIG. 4 in accordance with an exemplary embodiment.

An exemplary embodiment is now described with reference to FIGS. 4 and 5, where FIG. 4 is a schematic diagram showing a top view and a perspective view of a symmetric, multi-layer, three-way Wilkinson power divider in accordance with an exemplary embodiment of the invention and FIG. 5 is a schematic cross-sectional side view diagram showing the multi-layer structure of the three-way power divider of FIG. 4 in accordance with an exemplary embodiment. Generally speaking, the power divider includes a distribution port layer 100 and a common port layer 200 separated by one or more intermediate material layers 300 that generally consist of or include an insulation material layer. Such a power divider may be formed, for example, on a printed circuit board (PCB) or on a wafer (e.g., using MEMS or integrated circuit fabrication processes).

The distribution port layer 100 is formed of a conductive material and is configured to include three legs 2, 3, 4 representing the three distribution ports that are coupled to and arranged symmetrically around a center hub in a radial or pinwheel arrangement. Each pair of adjacent distribution legs is interconnected by an isolation resistor 5 that is electrically connected to each leg substantially at the quarter wavelength position of the leg relative to the center hub. For convenience, only one isolation resistor 5 is numbered in FIG. 4. Each isolation resistor 5 is preferably connected substantially mid-way between the adjacent legs, with resistor leads 8 (e.g., co-formed with the distribution legs) used to connect the isolation resistor 5 to the adjacent legs. For convenience, only one pair of resistor leads 8 is numbered in FIG. 4. In this example, each resistor lead 8 has a proximal end coupled to the distribution leg and a distal end at which the isolation resistor 5 is connected, e.g., the distal end including a pad for surface-mounting or other connection of the isolation resistor 5 to the resistor lead 8. In a specific exemplary embodiment, the isolation resistors 5 are 100 Ohm surface mount resistors of size 0201, although other types of resistors can be used in various alternative embodiments. In this example, the resistor leads 8 are curved resistor leads 8 such that the curved resistor leads 8 with connected isolation resistors 5 form a substantially circular ring interconnecting the three distribution port legs 2, 3, 4 substantially at the quarter wavelength position of the legs relative to the center hub. This ring arrangement for the isolation resistors is expected to improve isolation between the distribution ports. At the end of each distribution leg there is an interface 6 for connection to corresponding distribution circuitry (not shown for convenience) such as, for example, communication circuitry, phased array circuitry, radar circuitry, etc. For convenience, only one of the interfaces 6 is numbered in FIG. 4. In FIG. 4, the interfaces 6 are depicted as being below the distribution port layer 100 although it should be noted that the interfaces 6 can be below the distribution port layer 100, at the distribution port layer 100, or above the distribution port layer 100 depending on how the power divider is coupled to the ancillary distribution circuitry.

The common port layer 200 is formed of a conductive material and is configured to include a single leg 1 representing the common port. The common port leg 1 includes an oblong (e.g., tear-shaped) body 7 that electrically connects to the hub of the distribution port layer 100 by a conductive connection 9 (sometimes referred to as a "via") through the intermediate material layer(s) 300. Among other things, this oblong body 7 of the common port leg 1 is configured to improve matching to the three distribution legs compared to, for example, a circular body.

As depicted in FIG. 5, the three-way divider includes a distribution port layer 100 and a common port layer 200 separated by one or more intermediate layers 300. The oblong body 7 of the common port leg 1 is electrically coupled to the hub of the distribution port layer 100 by a conductive connection 9 (sometimes referred to as a "via") through the intermediate material layer(s) 200. The common port 1 can be connected to common circuitry (not shown for convenience) such as communication circuitry, phased array circuitry, radar circuitry, etc. such as for providing a common signal from the common circuitry to the distribution ports 2, 3, 4 and/or for providing a combined common signal from the distribution ports 2, 3, 4 to the common circuitry. The connection from the common port 1 to the ancillary circuitry can be below the common port layer 200, at the common port layer 200, or above the common port layer 200. It should be noted that the terms "distribution circuitry" and "common circuitry" are used to distinguish between circuitry coupled to the distribution legs and circuitry coupled to the common leg and is not limiting in any way.

In the example shown in FIG. 5, the three-way divider may be formed on a PCB, with the pads for the isolation resistors 5 and the interfaces 6 for the connections from the distribution ports 2, 3, 4 to the distribution circuitry on the top of the PCB, e.g., allowing for mounting of the isolation resistors 5 and connections to the distribution circuitry such as by surface mount, through-hole mount, solder mount, etc. In this example, the interface 11 for connection to the common port 1 is also on the top of the PCB, with a "via" 10 extending from the common port layer 200 to the top surface of the PCB, e.g., allowing for connection to the common circuitry such as by surface mount, through-hole mount, solder mount, etc.

Figure 6:
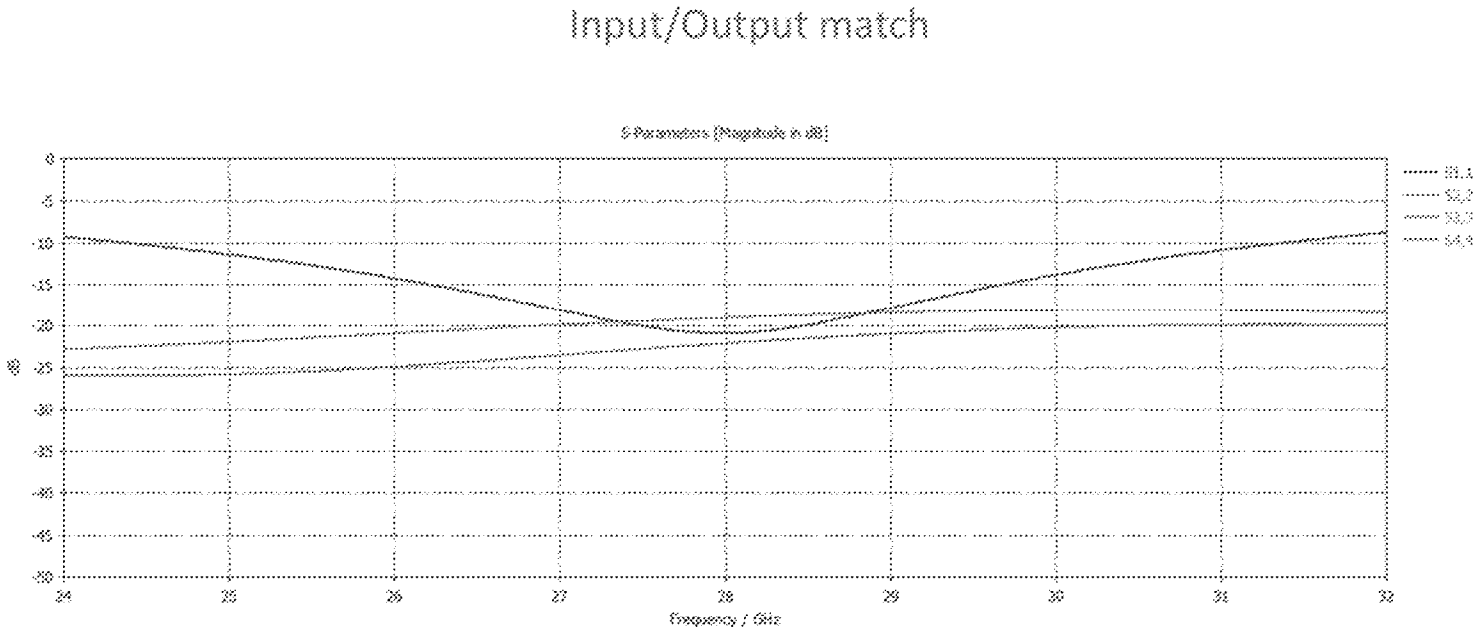
FIG. 6 is a graph showing expected input/output match for one exemplary embodiment as described herein.

FIG. 6 is a graph showing expected input/output match for one exemplary embodiment as described herein.

Figure 7:
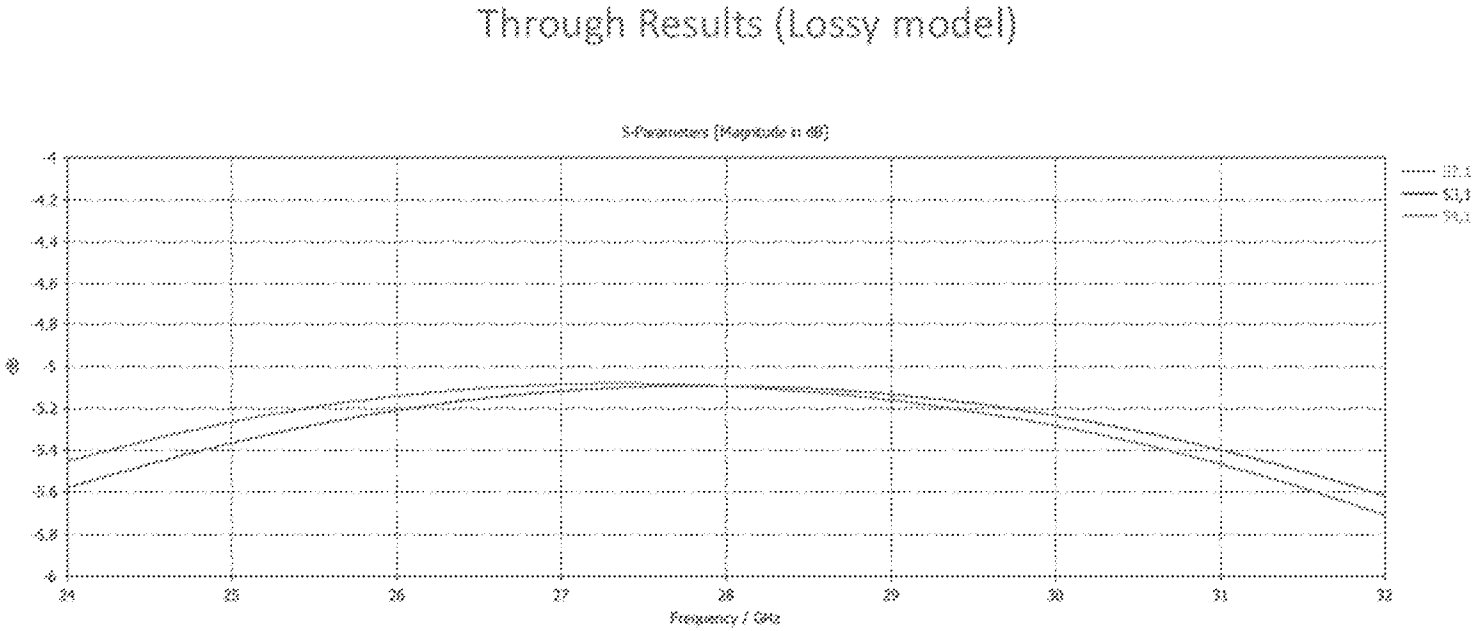
FIG. 7 is a graph showing expected through results (Lossy model) for one exemplary embodiment as described herein.

FIG. 7 is a graph showing expected through results (Lossy model) for one exemplary embodiment as described herein.

Figure 8:
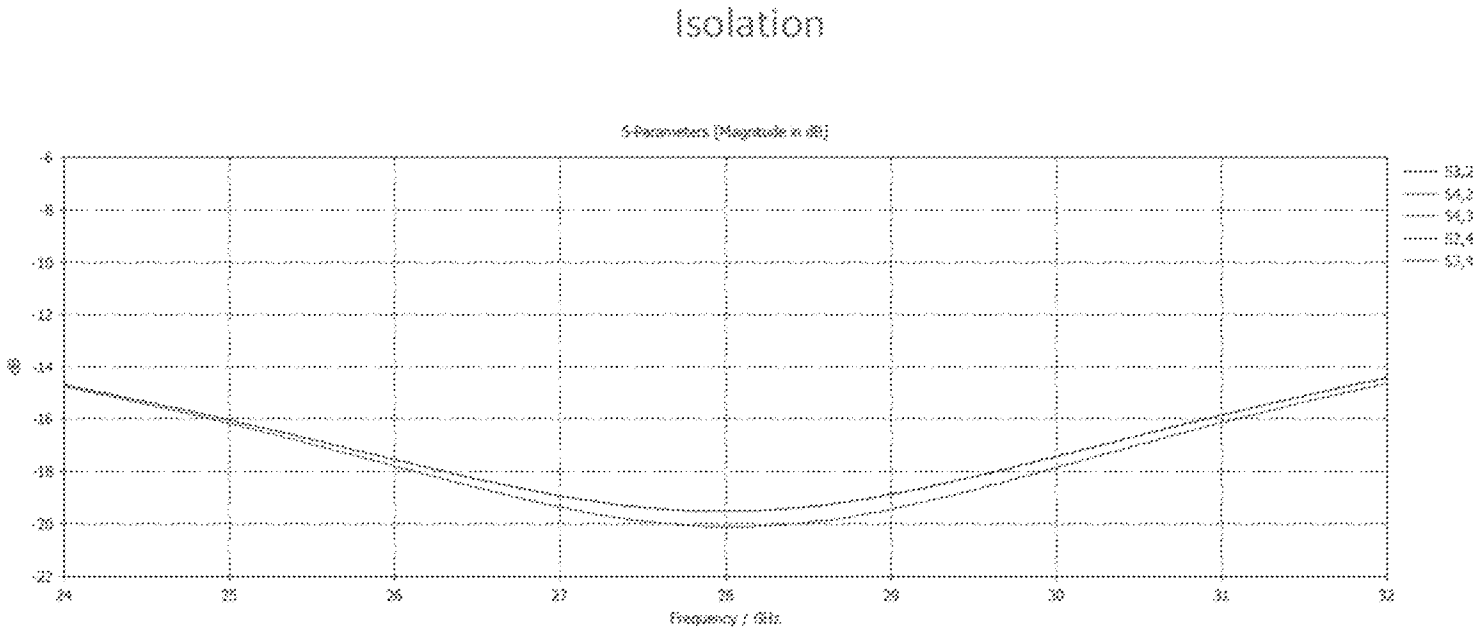
FIG. 8 is a graph showing expected isolation for one exemplary embodiment as described herein.

FIG. 8 is a graph showing expected isolation for one exemplary embodiment as described herein.

Figure 9:
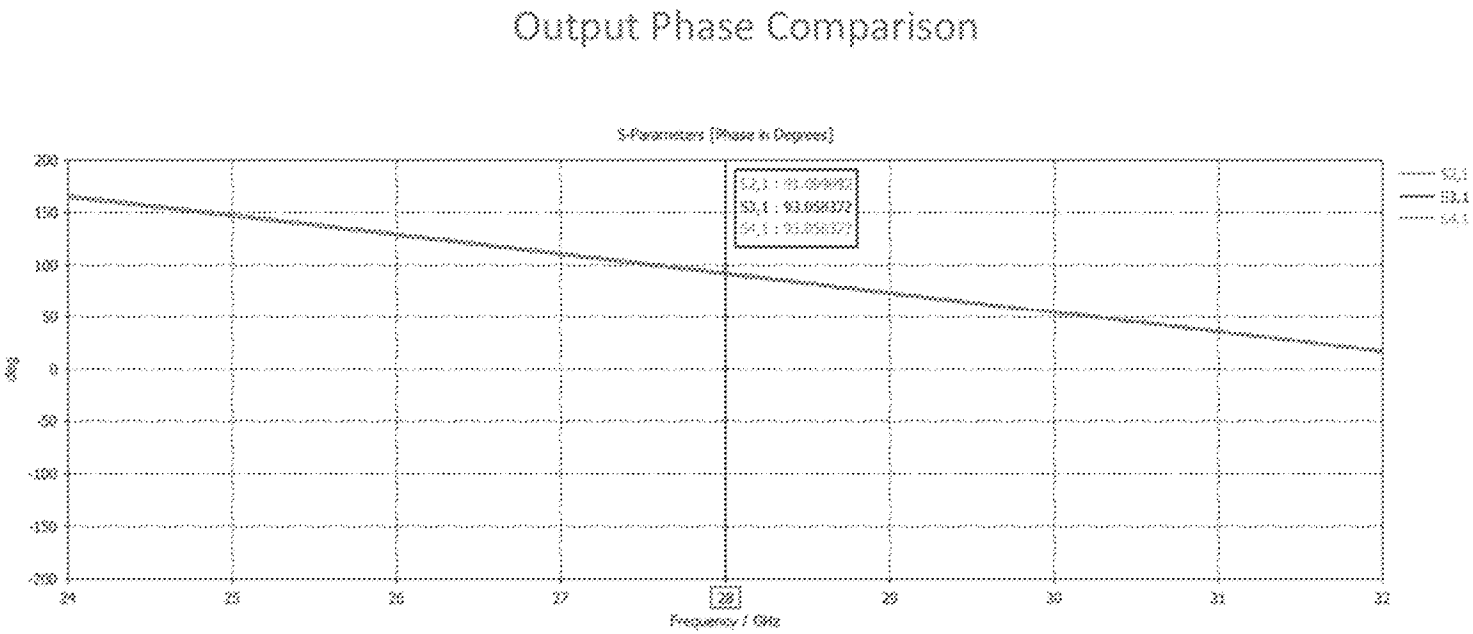
FIG. 9 is a graph showing an expected output phase comparison for one exemplary embodiment as described herein.

FIG. 9 is a graph showing an expected output phase comparison for one exemplary embodiment as described herein.

Without limitation, the three-way divider may be used in active electronically steered/scanned antenna systems ("AESA systems," a type of "phased array system") or active antenna systems such as to form electronically steerable beams for a wide variety of radar and communications systems. To that end, AESA systems typically have a plurality of beam-forming elements (e.g., antennas) that transmit and/or receive energy so that such energy can be coherently combined (i.e., in-phase and amplitude). This process is referred to in the art as "beamforming" or "beam steering." Specifically, for transmission, many AESA systems implement beam steering by providing various RF phase shift and gain settings. The phase settings and gain weights together constitute a complex beam weight between each beam-forming element. For a signal receiving mode, many AESA systems use a beamforming or summation point.

To achieve beam-forming using an antenna array, each antenna element may be connected to a semiconductor integrated circuit generally referred to as a "beam-forming IC" or BFIC. This microchip/integrated circuit may have a number of sub-circuit components implementing various functions. For example, those components may implement phase shifters, amplitude control modules or a variable gain amplifier (VGA), a power amplifier, a power combiner, a digital control, and other electronic functions. Such an integrated circuit is packaged to permit input and output radio frequency (RF) connections.

Figure 10:
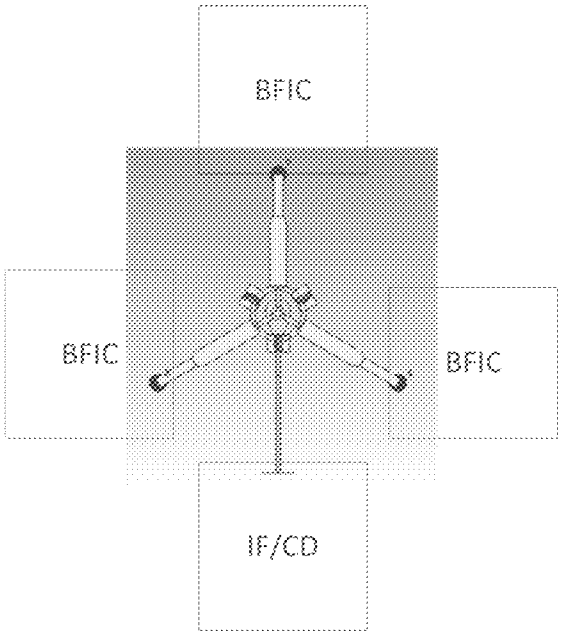
FIG. 10 is a schematic diagram showing how a three way divider of the type described herein can be used in forming an array, in accordance with one exemplary embodiment.

FIG. 10 is a schematic diagram showing how a three way divider of the type described herein can be used in forming an array, in accordance with one exemplary embodiment. In this exemplary embodiment, a beam-forming integrated circuit (BFIC) processes signals for a number of array elements, e.g., 1 element, 2 elements, 4 elements, etc. Signals to/from a number of BFIC chips are aggregated by a conditioning integrated circuit (CDIC) chip, and signals to/from a number of CDIC chips are aggregated by an interface integrated circuit (IFIC) chip. The BFIC chips, CDIC chips, and IFIC chips can be used to create different sized sub-arrays, and in some embodiments multiple sub-arrays are used to form larger arrays. Thus, one exemplary embodiment includes a chipset including a BFIC chip, a CDIC chip, and an IFIC chip that can be used in various combinations in order to produce various array and sub-array configurations. In exemplary embodiments, the three chips (CDIC, BFIC and IFIC) can be combined in a modular fashion and in combination they can create arbitrary arrays of any form factor and size. While the IFIC performs frequency translation, the CDIC is the IC that performs signal conditioning and distribution for an antenna array and feeds into the BFICs to form the beam(s). In typical situations, there are many antenna elements and thus many BFICs, but only a small number of CDIC and IFIC chips. The ability to form arbitrary arrays is very useful for 5G arrays such as those used for base station, consumer premise equipment, and user equipment (such cell phones). In FIG. 10, a common transmit signal processed by an IFIC and a CDIC may be provided by the three-way divider to three BFICs for producing a beam-formed transmit signal using 3N elements, where N is the number of elements supported by each BFIC. Similarly, received signals from the BFICs may be combined by the three way divider so as to provide a combined receive signal to the CDIC and IFIC.

Miscellaneous

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Various inventive concepts may be embodied as one or more methods, of which examples have been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Although the above discussion discloses various exemplary embodiments of the invention, it should be apparent that those skilled in the art can make various modifications that will achieve some of the advantages of the invention without departing from the true scope of the invention. Any references to the "invention" are intended to refer to exemplary embodiments of the invention and should not be construed to refer to all embodiments of the invention unless the context otherwise requires. The described embodiments are to be considered in all respects only as illustrative and not restrictive.

The embodiments of the invention described above are intended to be merely exemplary; numerous variations and modifications will be apparent to those skilled in the art. Such variations and modifications are intended to be within the scope of the present invention as defined by any of the appended innovations.

What is claimed is:

1. Apparatus comprising a three-way Wilkinson power divider for millimeter wave applications, the power divider comprising:

a distribution port layer and a common port layer separated by at least one intermediate material layer including at least one insulating material layer;

the distribution port layer formed of a first conductive material and including exactly three distribution legs connected to and arranged symmetrically around a center hub in a pinwheel arrangement with resistor leads substantially at a predetermined quarter wavelength position of the legs relative to the center hub for connection of isolation resistors substantially midway between each pair of adjacent distribution legs; and the common port layer formed of a second conductive material and including a common port leg having an oblong body that electrically connects to the center hub of the distribution port layer by a conductive connection through the at least one intermediate material layer, wherein the oblong body of the common port leg is configured for matching to the three distribution legs and wherein the power divider exhibits isolated and balanced operation at millimeter wave frequencies.

2. The apparatus of claim 1, wherein the resistor leads are curved.

3. The apparatus of claim 2, wherein the curved resistor leads are configured to form a substantially circular ring interconnecting the three distribution port legs substantially at the quarter wavelength position of the legs relative to the center hub when the isolation resistors are connected to the resistor leads.

4. The apparatus of claim 3, wherein the curved resistor leads and substantially circular ring provide enhanced isolation between the distribution ports.

5. The apparatus of claim 1, wherein each resistor lead includes a proximal end coupled to a distribution leg and a distal end having a pad for connecting an isolation resistor.

6. The apparatus of claim 5, wherein the pad is a pad for surface-mounting the isolation resistor.

7. The apparatus of claim 5, wherein the proximal end is co-formed with the distribution leg.

8. The apparatus of claim 1, wherein the oblong body is a tear-shaped body.

9. The apparatus of claim 1, wherein the conductive connection is a via.

10. The apparatus of claim 1, further comprising the isolation resistors connected to the resistor leads substantially midway between each pair of adjacent distribution legs.

11. The apparatus of claim 1, further comprising a printed circuit board (PCB) on which the power divider is embodied, the PCB including at least the distribution port layer and the common port layer separated by the at least one intermediate material layer including the at least one insulating material layer.

12. The apparatus of claim 11, further comprising:

first RF circuitry;

second RF circuitry; and third RF circuitry, wherein each of the first, second, and third RF circuitry is coupled to a distinct one of the three distribution legs, and wherein at least one of:

a common signal from the common port leg is distributed via the power divider to the first, second, and third RF circuitry; or signals from the first, second, and third RF circuitry are combined by the power divider to form a common signal provided to the common port leg.

13. The apparatus of claim 12, wherein each of the first, second, and third RF circuitry comprises beamforming circuitry.

14. The apparatus of claim 12, wherein each of the first, second, and third RF circuitry includes an RF integrated circuit.

15. The apparatus of claim 12, wherein each of the first, second, and third RF circuitry is coupled to at least one RF element.

16. The apparatus of claim 11, further comprising:

RF common circuitry coupled to the common port leg.

17. An RF integrated circuit for millimeter wave applications, the RF integrated circuit comprising:

a three-way Wilkinson power divider comprising:

a distribution port layer and a common port layer separated by at least one intermediate material layer including at least one insulating material layer;

the distribution port layer formed of a first conductive material and including exactly three distribution legs connected to and arranged symmetrically around a center hub in a pinwheel arrangement with isolation resistors connected to the legs substantially at a predetermined quarter wavelength position of the legs relative to the center hub and with the isolation resistors positioned substantially midway between each pair of adjacent distribution legs; and the common port layer formed of a second conductive material and including a common port leg having an oblong body that electrically connects to the center hub of the distribution port layer by a conductive connection through the at least one intermediate material layer, wherein the oblong body of the common port leg is configured for matching to the three distribution legs and wherein the power divider exhibits isolated and balanced operation at millimeter wave frequencies.

18. An RF integrated circuit according to claim 17, wherein the isolation resistors are coupled to the legs using curved resistor leads.

19. An RF integrated circuit according to claim 18, wherein the curved resistor leads with connected isolation resistors form a substantially circular ring interconnecting the three distribution port legs substantially at the quarter wavelength position of the legs relative to the center hub.

20. An RF integrated circuit according to claim 19, wherein the curved resistor leads and substantially circular ring provide enhanced isolation between the distribution ports.

21. An RF integrated circuit according to claim 17, wherein the oblong body is a tear-shaped body.

22. An RF integrated circuit according to claim 17, wherein the conductive connection is a via.

23. An RF integrated circuit according to claim 17, wherein the RF integrated circuit is a beamforming integrated circuit.

24. An RF integrated circuit according to claim 17, wherein the RF integrated circuit is a conditioning integrated circuit.

25. An RF integrated circuit according to claim 17, wherein the RF integrated circuit is an interface integrated circuit.

26. An RF integrated circuit according to claim 17, further comprising:

first RF circuitry;

second RF circuitry; and third RF circuitry, wherein each of the first, second, and third RF circuitry is coupled to a distinct one of the three distribution legs, and wherein at least one of:

a common signal from the common port leg is distributed via the power divider to the first, second, and third RF circuitry; or signals from the first, second, and third RF circuitry are combined by the power divider to form a common signal provided to the common port leg.

27. An RF integrated circuit according to claim 26, wherein each of the first, second, and third RF circuitry comprises beamforming circuitry.

28. An RF integrated circuit according to claim 17, further comprising:

RF common circuitry coupled to the common port leg.

29. A phased array system comprising:

first RF circuitry;

second RF circuitry;

third RF circuitry;

a three-way Wilkinson power divider comprising:

a distribution port layer and a common port layer separated by at least one intermediate material layer including at least one insulating material layer;

the distribution port layer formed of a first conductive material and including exactly three distribution legs connected to and arranged symmetrically around a center hub in a pinwheel arrangement with isolation resistors connected to the legs substantially at a predetermined quarter wavelength position of the legs relative to the center hub and with the isolation resistors positioned substantially midway between each pair of adjacent distribution legs; and the common port layer formed of a second conductive material and including a common port leg having an oblong body that electrically connects to the center hub of the distribution port layer by a conductive connection through the at least one intermediate material layer, wherein the oblong body of the common port leg is configured for matching to the three distribution legs and wherein the power divider exhibits isolated and balanced operation at millimeter wave frequencies, wherein each of the first, second, and third RF circuitry is coupled to a distinct one of the three distribution legs, and wherein at least one of:

a common signal from the common port leg is distributed via the power divider to the first, second, and third RF circuitry; or signals from the first, second, and third RF circuitry are combined by the power divider to form a common signal provided to the common port leg.

30. A phased array system according to claim 29, wherein each of the first, second, and third RF circuitry comprises beamforming circuitry.

31. A phased array system according to claim 29, wherein each of the first, second, and third RF circuitry includes an RF integrated circuit.

32. A phased array system according to claim 29, wherein each of the first, second, and third RF circuitry is coupled to at least one RF element.

33. A phased array system according to claim 29, further comprising:

RF common circuitry coupled to the common port leg.

* * * * *